US006409533B1

(12) United States Patent
Savage, Jr.

(10) Patent No.: US 6,409,533 B1
(45) Date of Patent: Jun. 25, 2002

(54) CONNECTOR LOCKING OF TERMINAL PINS AND HEADER

(76) Inventor: John M. Savage, Jr., 538-B Via De La Valle, Solana Beach, CA (US) 92075

( * ) Notice: Subject to any disclaimer, the term of this patent is extended or adjusted under 35 U.S.C. 154(b) by 0 days.

(21) Appl. No.: 09/849,411

(22) Filed: May 7, 2001

(51) Int. Cl.[7] ..... H01R 13/627
(52) U.S. Cl. ..... 439/358; 439/677; 439/746
(58) Field of Search ..... 439/357, 358, 439/674, 677, 680, 746

(56) References Cited

U.S. PATENT DOCUMENTS 5,368,503 A 11/1994 Savage, Jr.
5,426,265 A 6/1995 Savage, Jr.
5,466,174 A 11/1995 Savage, Jr.
5,938,467 A 8/1999 Savage, Jr.
6,186,837 B1 * 2/2001 Abe ..... 439/746
6,296,528 B1 * 10/2001 Roberts et al. ..... 439/677
6,312,293 B1 * 11/2001 Wang ..... 439/677

* cited by examiner

*Primary Examiner*—Tho D. Ta
(74) *Attorney, Agent, or Firm*—William W. Haefliger

(57) ABSTRACT

Apparatus connectable to a PC board comprising in combination at least one row of mounting terminals to be received in openings on the board; header structure associated with a row of terminals; support structure having openings to pass the terminals and support header structure; connector structure to interfit the terminals and interlock to the support structure, the connector structure adapted to carry wire terminals electrically connectable to the mounting terminals.

22 Claims, 8 Drawing Sheets

10
11a 11b
10b
10a 10
11

10
10e
10d
10f
10b
10a 11
10f
10d
10b
10c

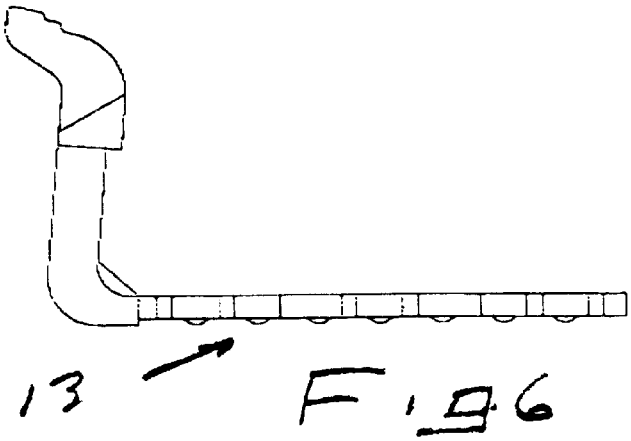
Fig 6
Fig 7
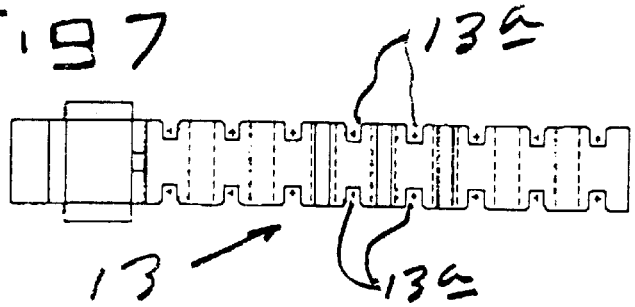
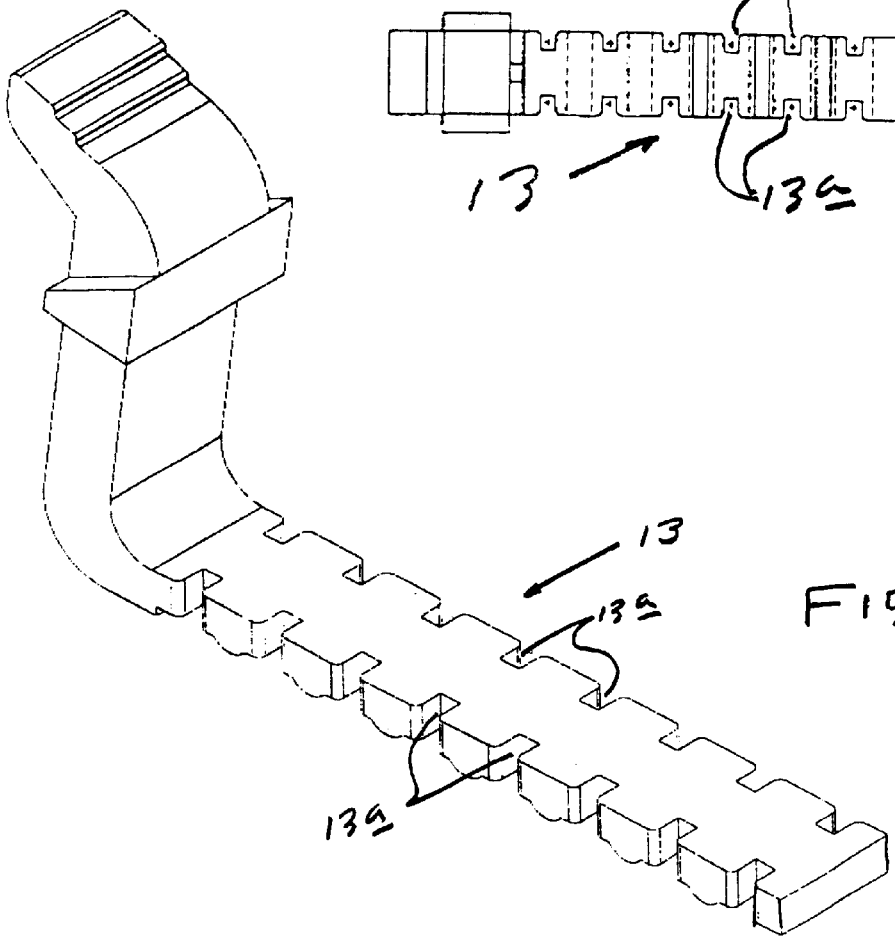
Fig 8

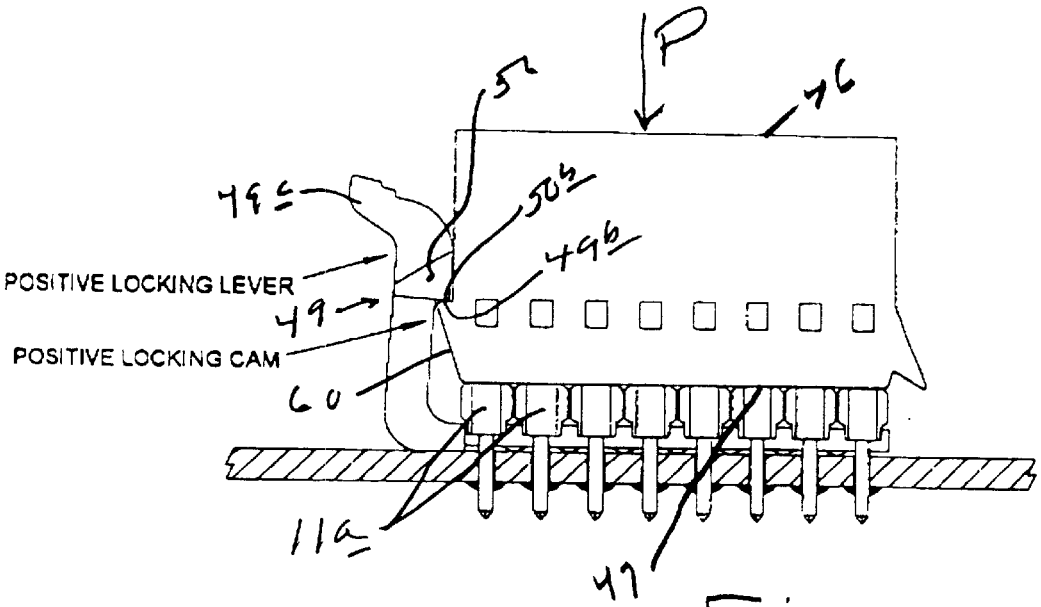
Fig 13
Fig 15
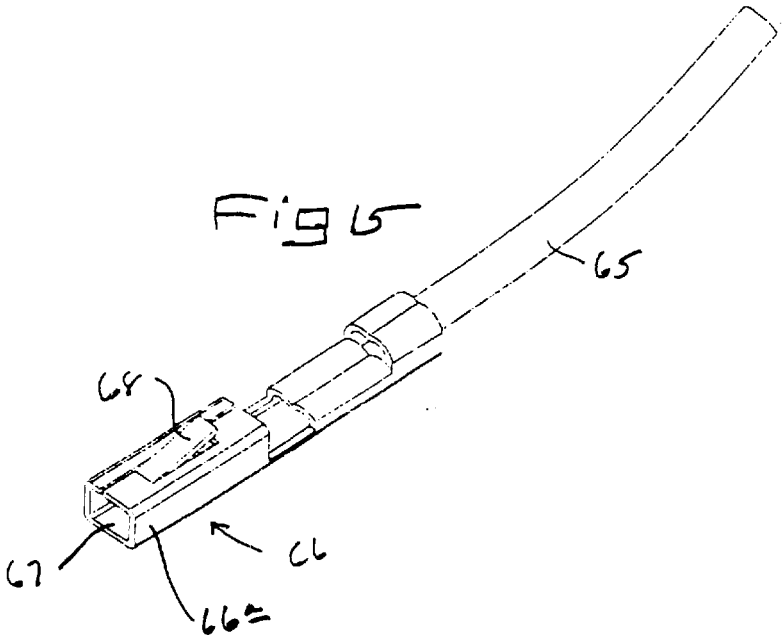

CONNECTOR LOCKING OF TERMINAL PINS AND HEADER

BACKGROUND OF THE INVENTION

This invention relates generally to connection of wire and wire terminal components to terminal pins connectable to a circuit board; and more particularly the invention concerns interconnection and interfitting of terminal and header structures to connector structures, and to locking interconnection of a wire connector to the terminal and header structures.

There is need for apparatus of the type referred to, and in particular there is need for such apparatus in which the components are easily assembled and remain assembled due to interlocking, and in which they may be easily assembled to a circuit board.

SUMMARY OF THE INVENTION

It is a major object of the invention to provide simple, effective and highly useful apparatus meeting the above needs. Basically, and in one form, the invention comprises a) at least one row of mounting terminals to be received in openings in the board, b) header structure associated with the row of terminals, c) support structure having openings to pass the terminals and support the header structure, d) and connector structure to interfit the terminals and interlock to the support structure, e) the connector structure adapted to carry wire terminals electrically connectable to the mounting terminals.

As will be seen, a projection may be provided on the support structure to interlock to said connector structure; and the projection and connector structure may have interengagable camming surfaces to deflect the projection in response to fitting of the connector structure on the mounting terminals.

It is another object to provide two longitudinally parallel rows of such mounting terminals, and in which the header structure is associated with the two rows. Typically, the mounting terminals in each of the rows extend laterally of mounting terminals in the other of the rows. Also, the header structure may include multiple heads respectively associated with the mounting terminals, certain pairs of heads extending in adjacent relation and defining break-away structure.

A further object is to provide such heads or headers so that selective break-away of groups of headers and associated mounting terminals is enabled.

Yet another object is to position the support structure for mounting on a circuit board, between the board and the header structure so that the mounting terminals may pass through interlock notches in the support structure.

These and other objects and advantages of the invention, as well as the details of an illustrative embodiment, will be more fully understood from the following specification and drawings, in which:

DRAWING DESCRIPTION

FIG. 6 is an elevation showing support structure;

FIG. 7 is a top plan view of the FIG. 6 support structure, and taken on lines 7—7 of FIG. 6;

FIG. 8 is a perspective view of the FIG. 6 and FIG. 7 support structure;

FIG. 13 is a view like FIG. 11, but showing the connector completely assembled to the terminals, header and lifter structures;

FIG. 15 is a perspective view of wire and wire terminal components to be assembled to the connector referred to above.

DETAILED DESCRIPTION

Figure 9:
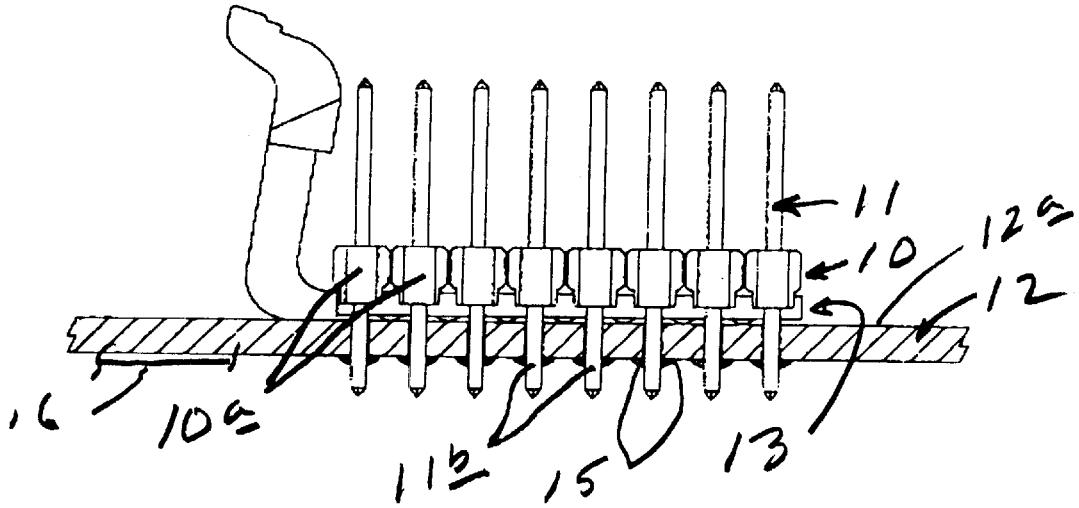
FIG. 9 is an elevation view showing the support structure assembled to the terminal and header structures, and on a circuit board.
Figure 10:
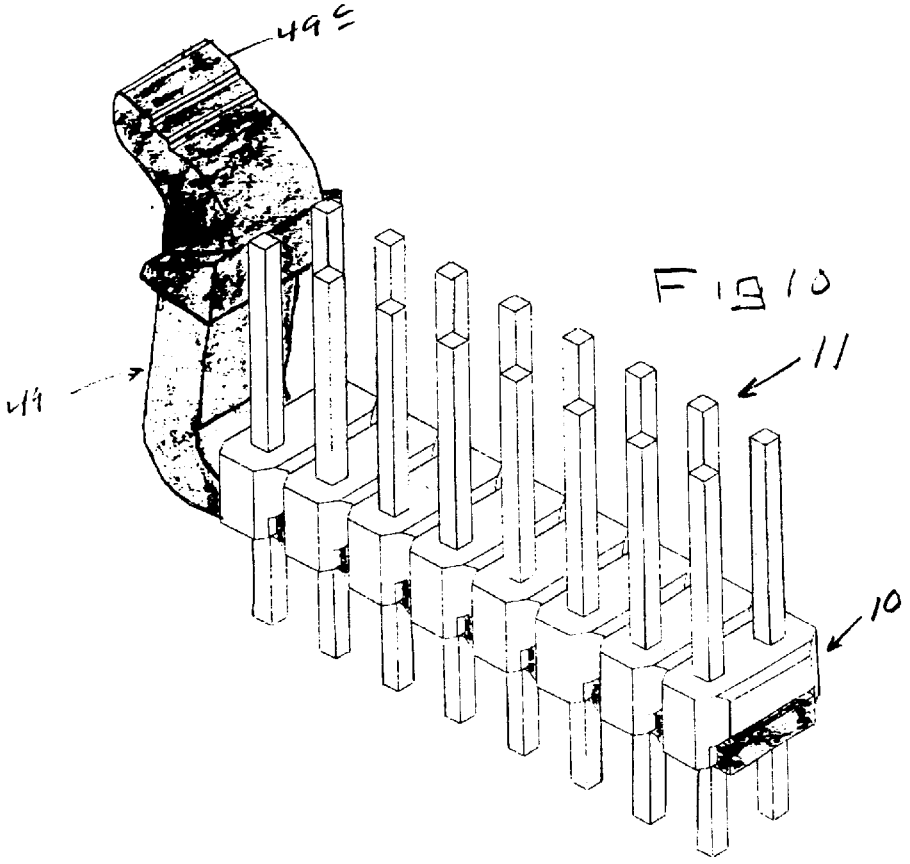
FIG. 10 is a perspective view of the support structure assembled to the terminal and header structures.

In FIGS. 1–5, header structure 10 includes a longitudinal row of heads or headers 10*a*, of which sequential headers are interconnected at reduced dimension zones 10*b*. The latter may have reduced thickness, or width, or height, to enable selective break-away so as to provide a reduced number of headers in a row. Mounting electrical terminals or pins 11 are associated with these headers, for use with a particular circuit, as on a circuit board 12 as seen in FIG. 9. The headers may consist of molded plastic material.

Figures 1, 2, 3, 4:
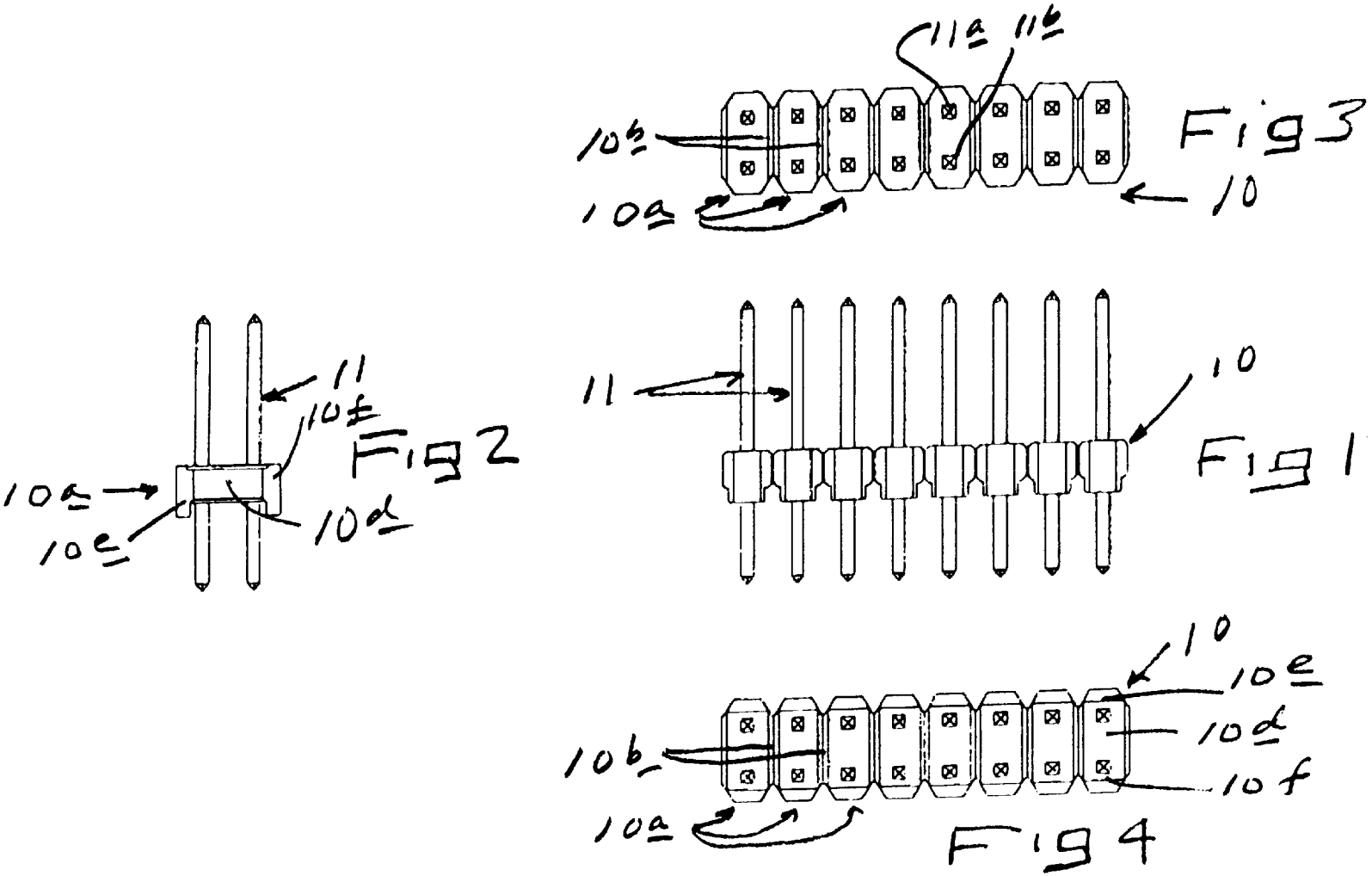
FIG. 1 is an elevation showing terminal and header structures.
FIG. 2 is an elevation taken on lines 2—2 of FIG. 1.
FIG. 3 is a top plan view taken on lines 3—3 of FIG. 1.
FIG. 4 is a bottom plan view taken on lines 4–4 of FIG. 1.
Figure 5:
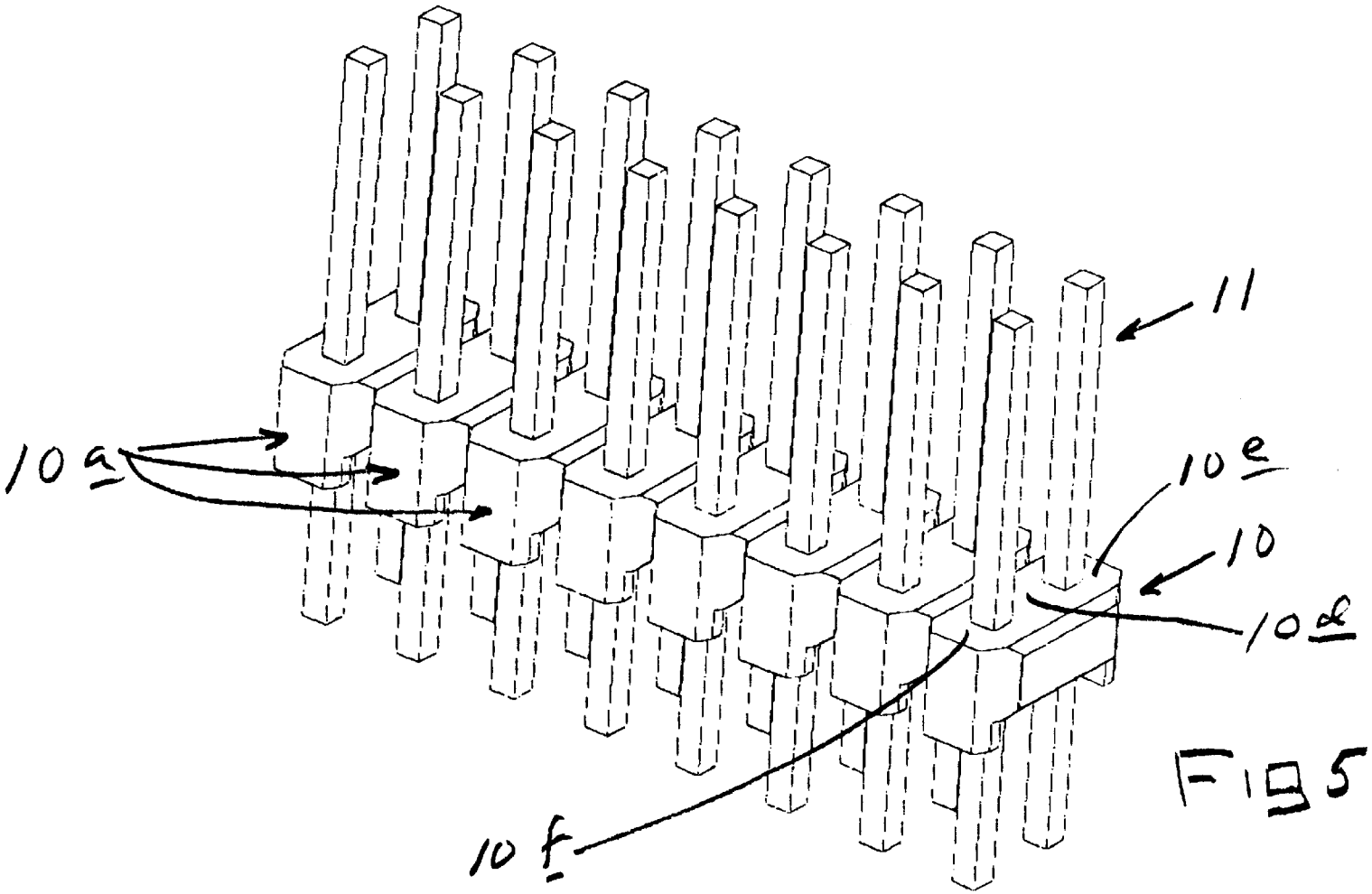
FIG. 5 is a perspective view of the FIGS. 1–4 terminal and header structures.

The mounting terminals associated with the headers may be located in two longitudinally parallel rows, as shown. Each header 10*a* is associated with, i.e. for example carries, two laterally spaced, upright mounting terminals, seen at 11*a* and 11*b* in FIGS. 3 and 4. For example, the terminals pass through openings in the headers, to extend above and below the headers, as seen in FIGS. 1 and 2. The terminals pass through certain portions 10*d* of the headers that are laterally intermediate other portions 10*e* and 10*f* of the headers. Portions 10*e* and 10*f* have greater vertical dimensions than portion 10*d*, for reinforcement.

Also provided is support structure 13 that extends longitudinally to receive and pass the lower extents of the terminals 11, as through openings 13*a* in the support structure. Also, as seen in FIG. 9, the support structure is configured to extend beneath the headers 10*a*, and to support them, in sandwiched relation between the headers and the top 12*a* of the circuit board 12. FIG. 9 also shows the lowermost extents 11*b* of the terminals 11 projecting from and below openings 12*b* of board 12, and electrically connected at 15, to circuitry 16, at the underside of the board.

FIG. 7 shows openings 13*a* in the form of edge notches in the support structure, for receiving and passing the mounting terminals 11, whereby the support structure is closely integrated with the heads or headers, and the terminals, as seen in FIG. 9, to provide a firm, stable interfitting structure. Such notches accommodate slight sideward deviation of terminals 11.

Also provided is connector structure to interfit the mounting terminals, and interlock to the support structure. In this regard, the connector structure is adapted to carry wire terminals electrically connectable to said mounting terminals.

Figure 11:
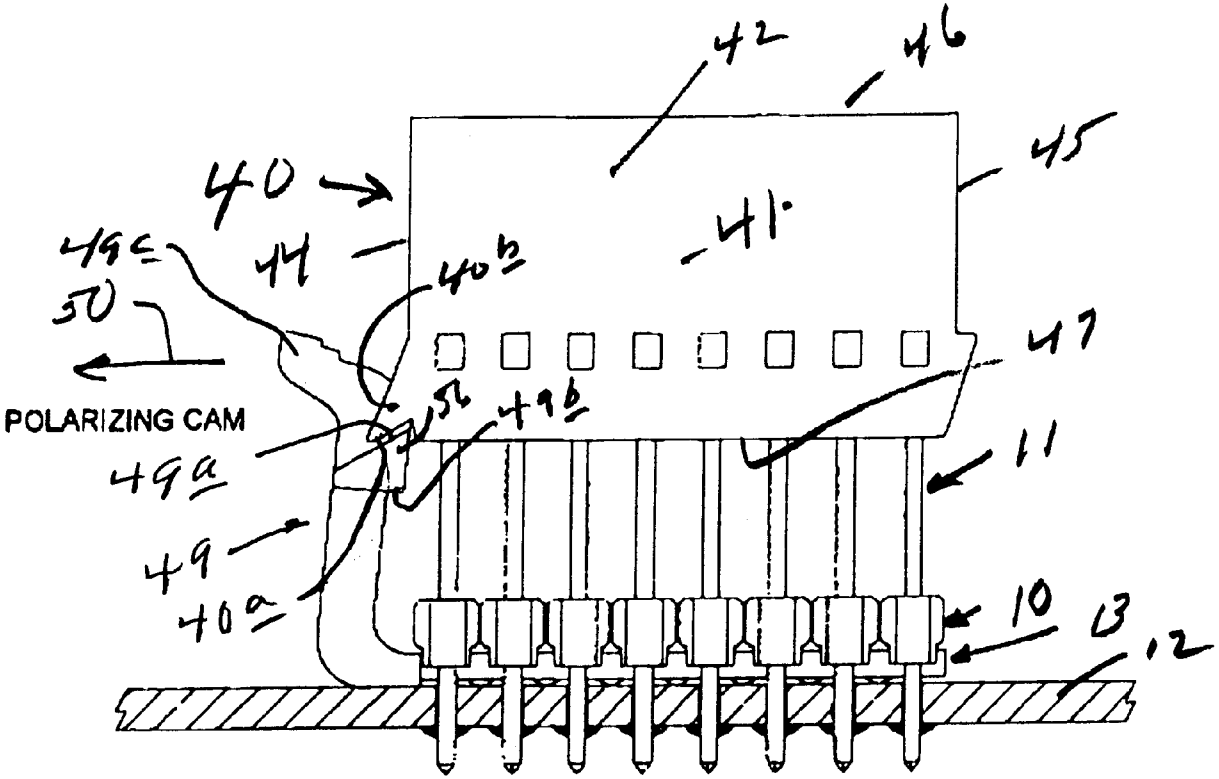
FIG. 11 is a view like FIG. 9, but showing a connector partially assembled to the terminals, header and support structure.
Figure 12:
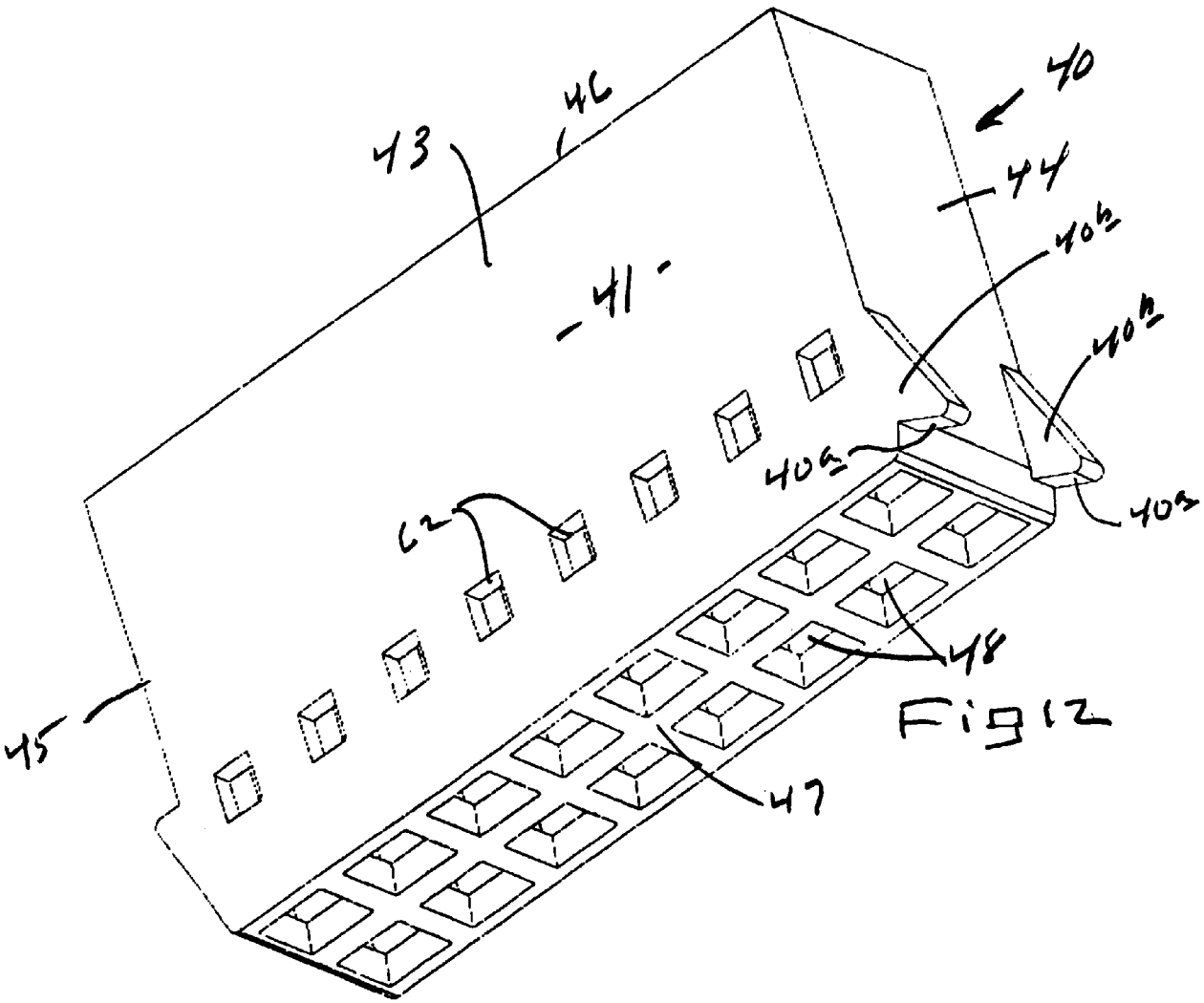
FIG. 12 is a perspective view of the connector seen in FIG. 11.
Figure 14:
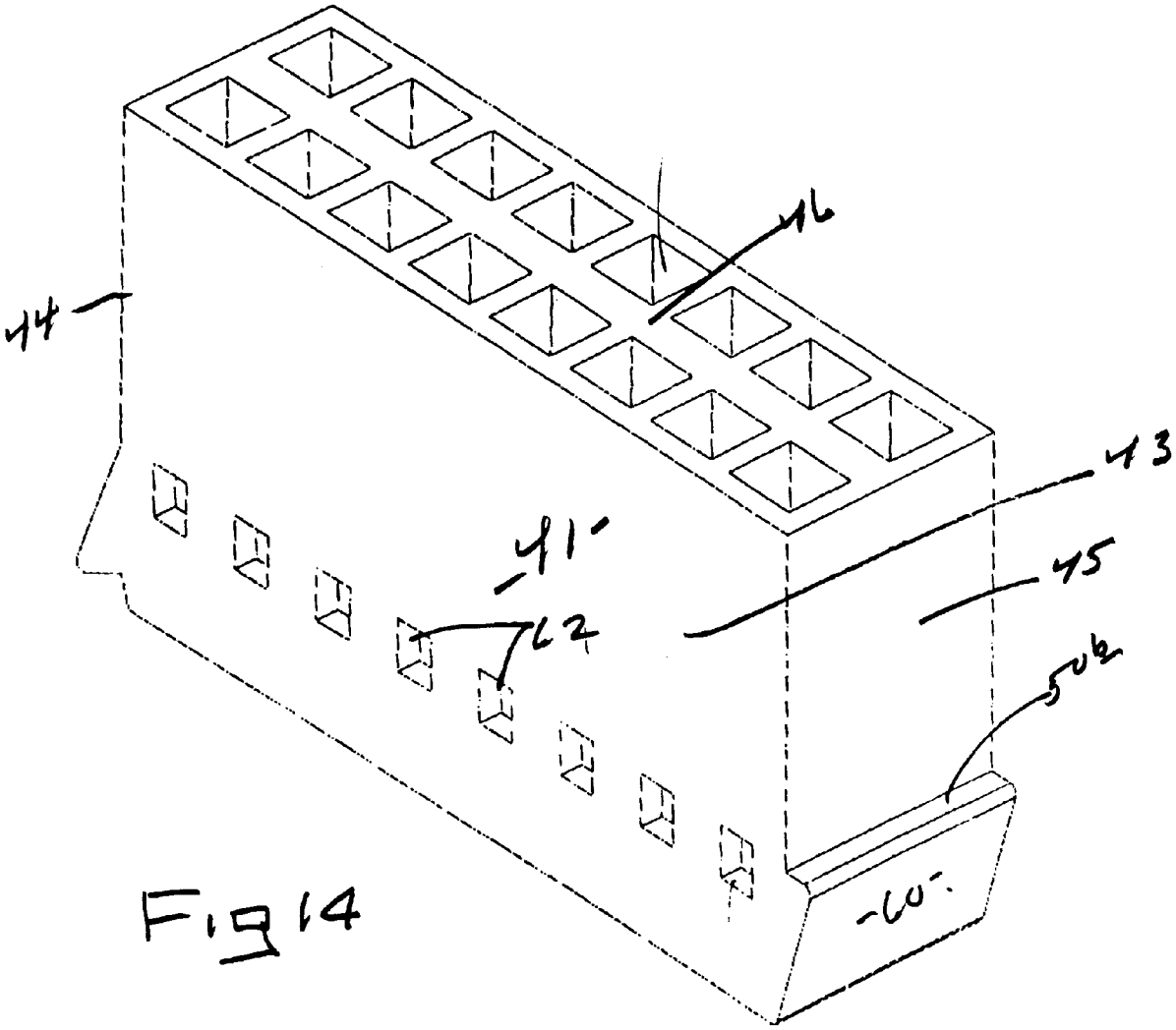
FIG. 14 is another perspective view of the connector seen in FIGS. 12 and 13.

In the preferred embodiment, as illustrated, a representative connector structure is seen at 40 in FIGS. 11–13 as comprising a body 41 having sides 42–45. It also has two rows of through openings 48 that extend between upper and lower surfaces 46 and 47 of the body. Lower portions of openings 48 receive upper portions of the mounting terminals, above the header structure 13, when the connector is pressed downwardly at P, as shown in FIG. 13.

An upwardly extending projection 49 at the end of the support structure 13 has a shoulder 49*a* that interferes with shoulders 40*a* on tangs 40*b* on the connector, to initially block further downward movement of the connector on the mounting terminals, whereby the connector is in FIG. 11 stopped position preventing insertion completion downwardly. When the connector 40 is endwise reversed, as shown in FIG. 13, the connector is then and thereby enabled to be completely pressed downwardly on terminals 11, so that the lower surface 47 of the connector body engages the tops of the headers 10*a*, to lock or hold the header structure 10 and support structure 13, in layered, assembled, sandwiched relation, between the connector 40 and the circuit board 12. At this time, the projection 49 has been allowed to bend or return resiliently rightwardly to FIG. 13 position, in which a shoulder 49*b* on projection 49 extends over a stop shoulder 50*b* on the connector, to lock the connector in position. Tapered or angled cam surface 60 on the connector acts to initially deflect projection 49 leftwardly in direction 50, and then to return rightwardly to FIG. 13 locking position.

Preferably, the shoulders 50*a* and 50*b* are at opposite ends of the connector, whereby the connector must be endwise positioned with shoulder 50*b* in aligned relation with shoulder 49*b* in order to achieve the interlock. Accordingly, the FIG. 11 position of the connector is a stopped position of the connector, which is blocked against further downward travel, by interengagement of shoulders 49*a* and 40*a*. A turned end portion 49*c* of the projection or lever 49 can be manually pushed downwardly to resiliently pivot the projection leftwardly, in FIG. 13, to release the interlock of shoulders 49*b* and 50*b*, enabling upward pulling of the connector off the terminals, for disassembly. Cams or lugs 54 and 55 which carry the shoulders at opposite ends of the connector, may be considered as polarizing i.e. endwise orienting cams, in that they pass or block downward travel of the connector to FIG. 13 position, depending upon which end of the connector is presented to cam element 56 on the projection.

FIG. 15 shows a wire 65 which is terminated at 66 for downward reception into the top of an opening 48 in the connector. Multiple such wires may thereby be connected with the upper ends of the mounting terminals 11 received in the connector. Note the polygonal opening formed at 67 in metallic female terminal 66*a*, to receive the polygonal cross section mounting terminal 11. A resiliently bendable metallic spring finger 68 on the terminal 66*a* is engagable with or into a window or opening 62 in the connector to provide a retention i.e. locking interfit.

I claim:

1. Apparatus connectable to a PC board comprising in combination a) at least one row of mounting terminals be received in openings in the board, b) header structure associated with said row of terminals, c) support structure having openings to pass said terminals, and support said header structure, d) and connector structure to interfit the terminals and interlock to the support structure, e) said connector structure adapted to carry wire terminals electrically connectable to said mounting terminals, f) the header structure including multiple heads respectively associated with said mounting terminals, certain pairs of said heads extending in adjacent relation and defining reduced thickness break-away structure.

2. The combination of claim 1 wherein each head interfits at least one of said mounting terminals.

3. The combination of claim 1 including said board to support the terminals, the support structure extending between said board and header structure.

4. The combination of claim 1 wherein said connector structure and said projection have interfitting surfaces to lock the connector structure to the header structure.

5. The combination of claim 1 including a projection on said support structure to interlock to said connector structure.

6. The combination of claim 5 wherein said projection extends proximate one end of said header structure.

7. The combination of claim 5 wherein said connector structure and projection have interengagable camming surfaces to deflect said projection in response to assembly of the connector structure onto mounting terminals.

8. The combination of claim 5 including a turned-end portion on the projection, to be deflected for releasing the interlock of said connector structure from said projection.

9. The combination of claim 5 wherein said projection has a shoulder to interlock with a first shoulder on the connector to establish said interlock.

10. The combination of claim 1 wherein there are two longitudinally parallel rows of said mounting terminals, and said header structure is associated with said two rows.

11. The combination of claim 10 wherein the mounting terminals in each of said rows extend laterally of the mounting terminals in the other of said rows.

12. The combination of claim 1 wherein said connector structure comprises a body having locking structure for interlocking to said wire terminals received into said body.

13. The invention of claim 12 wherein locking structure includes windows in said body, spaced from said mounting terminals.

14. The combination of claim 13 including said wire terminals which have spring fingers positioned to interengage said windows.

15. Apparatus connectable to a PC board comprising in combination a) at least one row of mounting terminals to be received in openings in the board, b) header structure associated with said row of terminals, c) support structure having openings to pass said terminals and support said header structure, d) and connector structure to interfit the terminals and interlock to the support structure, e) said connector structure adapted to carry wire terminals electrically connectable to said mounting terminals, f) there being two longitudinally parallel rows of said mounting terminals, and said header structure is associated with said two rows, g) the mounting terminals in each of said rows extending laterally of the mounting terminals in the other of said rows, h) and wherein the header structure includes multiple heads each associated with two laterally spaced mounting terminals, certain longitudinally spaced heads extending in adjacent relation and defining break-away structure.

16. The combination of claim 15 wherein each head interfits at least one of said mounting terminals.

17. The combination of claim 15 wherein said support structure extends longitudinally under all of said heads.

18. The combination of claim 17 wherein said support structure is longitudinally elongated and forms edge notches to pass said mounting terminals.

19. Apparatus connectable to a PC board comprising in combination a) at least one row of mounting terminals to be received in openings in the board, b) header structure associated with said row of terminals, c) support structure having openings to pass said terminals and support said header structure, d) and connector structure to interfit the terminals and interlock to the support structure, e) said connector structure adapted to carry wire terminals electrically connectable to said mounting terminals, f) there being a projection on said support structure to interlock to said connector structure, g) said projection having a shoulder to interlock with a first shoulder on the connector to establish said interlock, h) and including a second shoulder on the connector to engage the projection, thereby blocking completed assembly of the connector to said terminals.

20. A connector to connect to multiple electrical terminals, said connector including a body having spaced walls, a first shoulder on the connector proximate one of said walls, and a second shoulder on the connector proximate another of said walls, said first shoulder positioned to engage a blocking shoulder on auxiliary structure associated with said terminals, to block full assembly of the connector onto the terminals, said second shoulder positioned to engage a camming shoulder on said auxiliary structure, to displace said camming shoulder thereby allowing full assembly of the connector onto said terminals.

21. The connector of claim 20 wherein said first and second shoulders are at or proximate opposite end walls of the connector.

22. The connector of claim 20 wherein said first shoulder is a stop shoulder, and said second shoulder is an angularly tapered camming shoulder.

* * * * *